US006658131B2

(12) United States Patent
Smith

(10) Patent No.: US 6,658,131 B2
(45) Date of Patent: Dec. 2, 2003

(54) LOUDSPEAKER CONCEALMENT SYSTEM

(76) Inventor: James T. Smith, 22216 Gulf Ave., Carson, CA (US) 90745

( * ) Notice: Subject to any disclaimer, the term of this patent is extended or adjusted under 35 U.S.C. 154(b) by 353 days.

(21) Appl. No.: 09/800,933

(22) Filed: Mar. 6, 2001

(65) Prior Publication Data

US 2002/0126866 A1 Sep. 12, 2002

(51) Int. Cl.[7] ..... H04R 25/00
(52) U.S. Cl. ..... 381/386; 381/87
(58) Field of Search ..... 381/87, 332, 333, 381/334, 336; 181/386, 388, 387, 189, 199; 312/204, 208.4; 248/441.1, 445

(56) References Cited

U.S. PATENT DOCUMENTS

| | | | |
|---|---|---|---|
| 1,262,269 A | | 4/1918 | Scherer |
| 1,653,891 A | | 12/1927 | De Graff |
| 1,876,779 A | | 9/1932 | Smith |
| 1,930,757 A | | 10/1933 | Kirke et al. |
| 2,077,975 A | | 4/1937 | Wolff |
| 2,924,661 A | | 2/1960 | Messeas, Jr. |
| 2,992,695 A | | 7/1961 | Everitt |
| 4,768,870 A | | 9/1988 | Chen |
| 4,781,384 A | * | 11/1988 | Bois |
| 4,805,730 A | | 2/1989 | O'Neill et al. |
| D337,349 S | | 7/1993 | Woodburn |
| D347,435 S | | 5/1994 | Snell |
| 5,403,080 A | | 4/1995 | Thee |
| 5,444,194 A | | 8/1995 | Reinke |
| 5,995,634 A | | 11/1999 | Zwolski |
| 6,021,208 A | | 2/2000 | Kin-Lung |
| 6,035,962 A | | 3/2000 | Lin |

FOREIGN PATENT DOCUMENTS

| | | | |
|---|---|---|---|
| DE | 29606516 | * | 1/1996 |
| FR | 782095 | | 5/1935 |
| IT | 452388 | | 10/1949 |

OTHER PUBLICATIONS

Old–House Interiors (magazine), Winter 1998, p. 17.

* cited by examiner

*Primary Examiner*—Sinh Tran
(74) *Attorney, Agent, or Firm*—David Weiss

(57) ABSTRACT

An apparatus and method for concealing a loudspeaker, in which frame modules simulating books are juxtaposed for forming a housing for the speaker. The housing appears as a row or stack of books, and the quantity of frame modules or simulated books may be adjusted for accommodating speakers of different widths or heights.

23 Claims, 2 Drawing Sheets

LOUDSPEAKER CONCEALMENT SYSTEM

FIELD OF THE INVENTION

This invention relates to loudspeaker concealment systems, and more particularly to simulated book enclosures for facilitating the visual concealment of loudspeakers.

BACKGROUND OF THE INVENTION

Music and audiovisual entertainment systems, for home or office, include at least one (and often as many as five or more) audio channels each of which require a loudspeaker for full audio enjoyment. Many persons find typical loudspeakers to be visually obtrusive and/or not compatible with a particular decor. Such persons desire to enjoy the accurate reproduction of music and home theater audio, but they do not want their living and work spaces to look like the sound rooms of their local audio dealers.

A popular speaker is the so-called bookshelf speaker in which one or more loudspeakers are housed in a cabinet, generally designed for being situated on a bookshelf. Speaker cabinets are of boxlike configuration of generally rectangular sides, and contain at least one loudspeaker (typically a mid-range speaker, a tweeter and/or a woofer) forwardly facing and which may be covered by a substantially rectangular grille of sound transmissible fabric. The perceived obtrusiveness of bookshelf speakers arranged around a room, whether on bookshelves or on furniture or mounted on walls, has resulted in various devices for concealing such speakers from direct view.

SUMMARY OF THE INVENTIONS

The present invention employs a modular approach for concealing a loudspeaker, in which frame modules simulating books are juxtaposed for forming a housing for the speaker. The housing appears as a row or stack of books, and the quantity of frame modules or simulated books may be adjusted for accommodating speakers of different widths or heights.

In a preferred embodiment of the invention, apparatus is provided for concealing a loudspeaker, such apparatus comprising the combination of: a generally rectangular individual first frame having a forward wall representing the spine of a first book, a rear wall representing the fore-edges of the leaves of the first book, a top wall representing the top edges of the leaves of the first book, a bottom wall representing the bottom edges of the leaves of the first book, and a left side wall representing the back cover of the first book; a generally rectangular individual second frame having a forward wall representing the spine of a second book, a rear wall representing the fore-edges of the leaves of the second book, a top wall representing the top edges of the leaves of the second book, a bottom wall representing the bottom edges of the leaves of the second book, and a right side wall representing the front cover of the second book; at least one generally rectangular individual third frame, each of the at least one third frame having a sound-transmissible forward wall representing the spine of another book, a rear wall representing the fore-edges of the leaves of the other book, a top wall representing the top edges of the leaves of the other book, and a bottom wall representing the bottom edges of the leaves of the other book; the individual frames adapted to be juxtaposed with the at least one third frame between the first frame and the second frame to form a housing for the loudspeaker. The outer surface of the forward wall of each of the at least one third frame is covered with a sound transmissible fabric for simulating the spine of the other book, and the forward wall of each of the first and second frames is covered with fabric for simulating the spines of the first and second books. The outer surfaces of the top, rear and bottom walls of each of the first and second frames, and of each of the at least one third frame, may be decorated to simulate the leaves of the first, second and other books, which decoration may take the form of a fabric covering. The outer surface of the side walls of each of the first and second frames are preferably covered with fabric for simulating the back cover of the first book and the front cover of the second book.

According to one aspect of the present invention, an apparatus for concealing a loudspeaker comprises the combination of: a plurality of generally rectangular first frames each having a sound transmissible forward wall simulating the spine of a book, a top wall and a bottom wall each perpendicularly extending from the second wall, and a rear wall parallel to the forward wall, each of the first frames including an opening within the boundaries of the walls, the frames adapted to be juxtaposed with the openings aligned to form a housing for the loudspeaker. The apparatus preferably further includes: a generally rectangular second frame having a forward wall simulating the spine of another book, a top wall and a bottom wall each perpendicularly extending from the forward wall, a rear wall parallel to the forward wall, and a right side wall simulating the front cover of the other book, the second frame including an opening within the boundaries of the forward, top, rear and bottom walls of the second frame, the second frame adapted to be juxtaposed with the first frames with the openings aligned to form the housing. The apparatus preferably additionally includes a generally rectangular third frame having a forward wall simulating the spine of a further book, a top wall and a bottom wall each perpendicularly extending from the forward wall, a rear wall parallel to the forward wall, and a left side wall simulating the back cover of the further book, the third frame including an opening within the boundaries of the forward, top, rear and bottom walls of the third frame, the third frame adapted to be juxtaposed with the first frames and with the openings aligned to form the housing. The third frame may also be juxtaposed with the first frames between the second and third frames and with the openings aligned to form the housing.

According to another aspect of the present invention, apparatus for concealing a loudspeaker comprises the combination of: a first frame having a generally rectangular opening, the first frame including a forward wall representing the spine of a first book and a left side wall closing the opening; a second frame having a generally rectangular opening, the second frame including a forward wall representing the spine of a second book and a right side wall representing the front cover of the second book closing the opening; at least one third frame, each of the at least one third frame having a generally rectangular opening and a sound transmissible forward wall representing the spine of another book; the frames adapted to be juxtaposed with the at least one third frame between the first frame and the second frame and with the openings aligned to form a housing for the loudspeaker. The first frame preferably includes a top wall representing the top edges of the leaves of the first book; the second frame preferably includes a top wall representing the top edges of the leaves of the second book; and each of the at least one third frame preferably includes a top wall representing the top edges of the leaves of the other book. The first frame of such apparatus preferably includes a rear wall representing the fore-edges of the leaves of the first book and a bottom wall representing the bottom edges of the leaves of the first book; the second frame preferably includes a rear wall representing the fore-edges of the leaves of the second book, and a bottom wall representing the bottom edges of the leaves of the second book; and the at least one third frame preferably includes a rear wall representing the fore-edges of the leaves of the other book, and a bottom wall representing the bottom edges of the leaves of the other book. The frames are preferably generally rectangular.

According to another aspect of the present invention, there is provided a method of concealing a loudspeaker comprising: providing a plurality of intermediate frames each having a rectangular opening and simulating the spine and leaf edges of a book; and juxtaposing the plurality of intermediate frames with their openings aligned to form a tunnel for containing the loudspeaker. The method further includes: providing the loudspeaker; and placing the loudspeaker in the tunnel.

According to another aspect of the invention, the method of concealing a loudspeaker comprises: providing a left side frame having a rectangular opening and simulating the back cover, the spine and the leaf edges of a book; providing a right side frame having a rectangular opening and simulating the front cover, the spine and the leaf edges of a book; providing a plurality of intermediate frames each having a rectangular opening and simulating the spine and leaf edges of a book; providing the loudspeaker; juxtaposing the plurality of intermediate frames with their openings aligned to form a tunnel; placing the loudspeaker in the tunnel; and placing one of the side frames on a side of the tunnel with the openings aligned. The method may further include: placing the other one of the side frames on the other side of the tunnel with the openings aligned for enclosing the loudspeaker.

BRIEF DESCRIPTION OF THE DRAWINGS

The novel features believed to be characteristic of the invention, together with further advantages thereof, will be better understood from the following description considered in connection with the accompanying drawings in which a preferred embodiment of the present invention is illustrated by way of example. It is to be expressly understood, however, that the drawings are for the purpose of illustration and description only and are not intended as a definition of the limits of the invention.

DESCRIPTION OF THE PREFERRED EMBODIMENT

Figure 1:
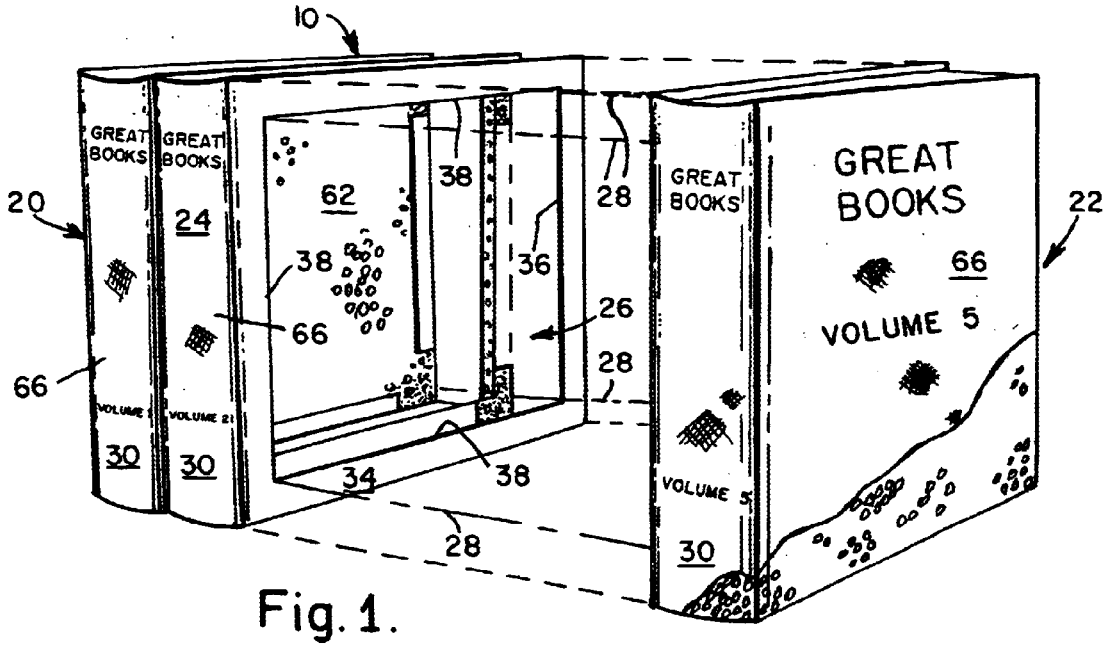
FIG. 1 is a front/right side perspective representation of a preferred embodiment of a loudspeaker concealment apparatus in accordance with the present invention.
Figure 2:
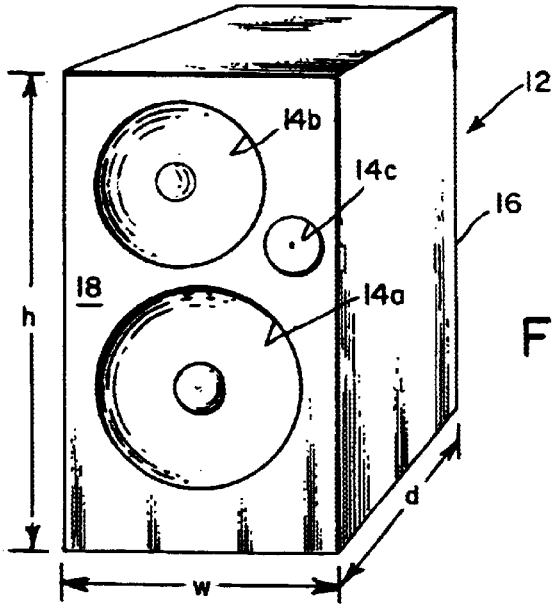
FIG. 2 is a front perspective view of an example of a conventional bookshelf loudspeaker that may be used with the embodiment of the loudspeaker concealment apparatus shown in FIG. 1.

Turning to FIG. 1, a preferred embodiment of a housing 10 is shown, for concealing a loudspeaker such as the loudspeaker 12 shown in FIG. 2. The loudspeaker 12 is a typical example of a bookshelf speaker, which may include one or more speakers 14 (such as a woofer 14*a*, a mid-range speaker 14*b* and a tweeter 14*c*) housed in a cabinet 16; the speakers 14 and their cabinet 16 are referred to herein simply as a bookshelf speaker or the loudspeaker 12.

As shown in FIG. 2, the bookshelf speaker 12 has six rectangular sides, including a front side 18 to which the speakers 14 are attached and from which the speakers' sound may project. The loudspeaker 12 has a height dimension h, a width dimension w, and a depth dimension d as noted in FIG. 2.

Figure 3:
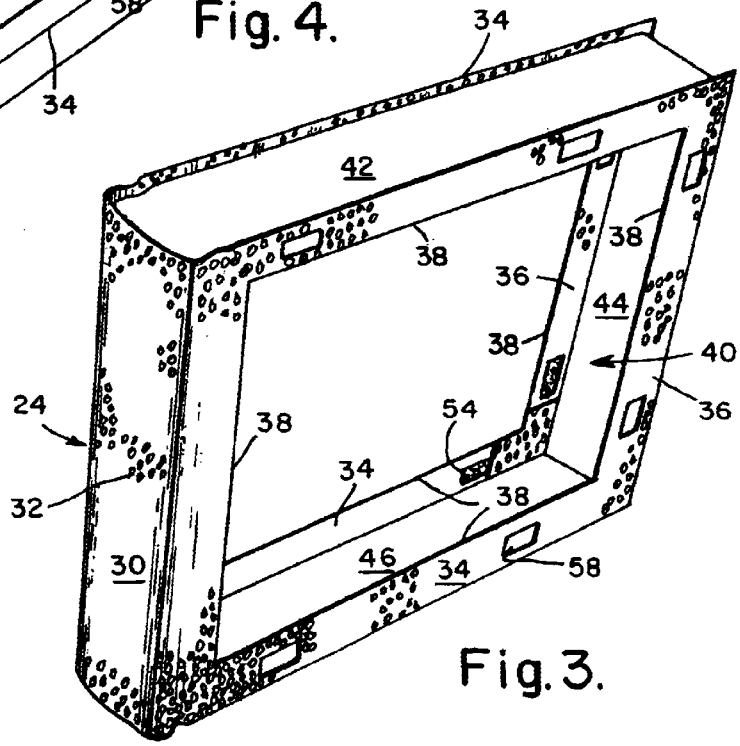
FIG. 3 is a front/right side perspective view of a preferred embodiment of one of the frame modules shown in FIG. 1.

Returning to FIG. 1 and considered along with FIG. 3, the loudspeaker concealment housing 10 is modular in construction, the modules comprising a left side frame 20, a right side frame 22, and at least one intermediate frame 24, juxtaposed to simulate a plurality of books and forming the housing 10 having an interior chamber defined by the lines 26. The dimensions of the chamber 26 are slighter greater than the dimensions of the loudspeaker 12 such that the loudspeaker 12 may be contained within the chamber 26 with the loudspeaker's front side 18 facing forwardly.

One of the intermediate frame modules 24 is shown in FIG. 3, and may be constructed of sheet metal such as stainless steel or aluminum, or of a plastic. Each intermediate rectangular frame 24 simulates a book having a rectangular passage or opening 40 therethrough.

Each intermediate frame 24 includes a forward wall 30 representing the spine of a book; the forward wall 30 may be flat or slightly curved to more closely simulate the book's spine. The forward wall 30 of frame 24 is sound transmissible; in the example of FIG. 3, the forward wall 30 includes perforations 32 therethrough for permitting sound generated by a contained loudspeaker 12 to be transmitted through the forward wall 30. Rearwardly extending from the top and bottom of the forward wall 30 are arms or longitudinal members 34 terminating with a longitudinal connecting member 36 perpendicular to the members 34, the outer edges of the members 34, 36 representing the upper, lower and right edges of each book's front and back covers. The inner edges 38 of the members 34, 36, in addition to edges 38 of the frame 24 along or adjacent to the forward wall 30, define the rectangular opening 40 through the frame 24.

The preferred embodiment of the intermediate frame module 24 further includes a top wall 42 rearwardly extending substantially perpendicularly from the forward wall 30, the top wall 42 representing the top edges of the leaves of the book. In addition, the frame 24 may include a rear wall 44 substantially parallel to the frame's forward wall 30, the rear wall 44 representing the fore-edges of the leaves of the book. A bottom wall 46 may further be included, rearwardly extending substantially perpendicularly from the forward wall 30 and representing the bottom edges of the leaves of the book.

Figure 4:
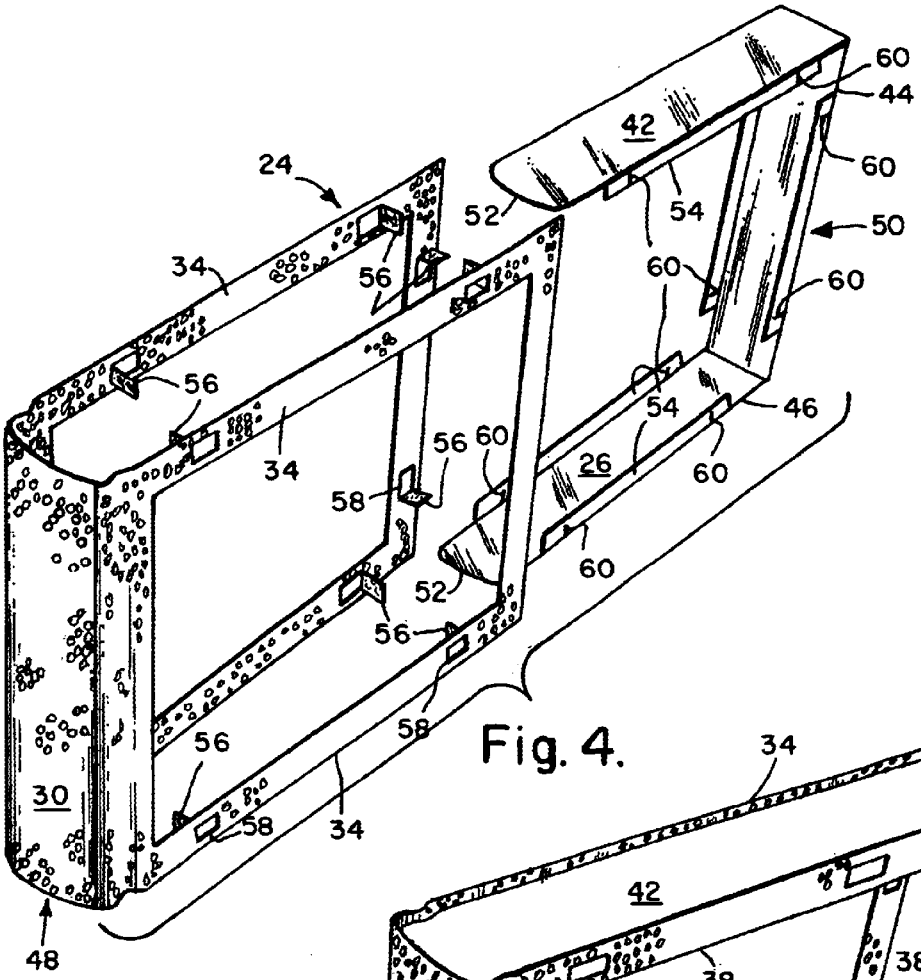
FIG. 4 is an exploded front/side perspective view of the frame module of FIG. 3, showing the frame components thereof.

FIG. 4 illustrates one manner of fabricating the preferred embodiment of the intermediate frame module 24. A first frame component 48 comprises the perforated spine 30 and the members 34, 36, and is preferably manufactured in one piece, e.g. the members 34, 36 may be of perforated sheet metal or plastic since the spine 30 is of perforated sheet metal or plastic. A second frame component 50 includes the top wall 42, the rear wall 44 and the bottom wall 46, and is inserted between the members 34, 36 and with its forward edges 52 against or in proximity to the inner surface of the forward wall 30. The first and second frame components 48, 50 are fastened to one another when in this position, such as by securing the longitudinal members 34, 36 of the first frame component 48 to longitudinal tabs 54 depending along each long side of the top, rear and bottom walls 42, 44, 46 of the second frame component 50. In a preferred example for providing such fastening, inwardly extending tabs 56 formed from U-shaped cutouts 58 in the members 34, 36 of the first frame component 48, are inserted into correspondingly positioned slots 60 in the longitudinal tabs 54 of the second frame component 50. After such insertion, the tabs 56 are bent toward the longitudinal tabs 54, resulting in the first and second frame components 48, 50 being secured to one another as shown in FIG. 3. Other attachment devices, such as screw fasteners inserted in apertures in the members 34, 36 and in the longitudinal tabs 60, may alternatively be utilized.

Returning to FIG. 1 considered along with FIG. 3, the left side frame 20 is preferably identical to the intermediate frame 24, except that the left side frame 20 includes a left side wall 62 in place of the members 34, 36, the left side wall 62 representing the back cover of a book. Similarly, the right side frame 22 is preferably identical to the intermediate frame 24, except that a right side wall 64 replaces the right side elements 34, 36 of the intermediate frame 24, the right side wall 64 representing the front cover of the book. Although sound transmissibility is preferred, the forward walls 30 of the left side frame 20 and the right side frame 22 need not be sound transmissible and may alternatively be constructed of non-perforated material.

The outer surfaces of the forward walls 30 of the preferred embodiments of the frame modules 20, 22, 24 are covered with fabric 66 to better simulate the spines of books, and the outer surface of the left side wall 62 and of the right side wall 64 is adheredly covered with fabric to better simulate the back and front covers of books. At least with respect to the intermediate frame modules 24, the fabric 66 covering the spines is sound transmissible, such as conventional speaker cloth. It is noted that in FIG. 1 the fabric 66 is shown partially removed from the spine 30 and right side wall 64 of the right side frame module 22 in order to better show these features for the purpose of explanation.

Although the forward, left side and right side walls 30, 62, 64 are shown as perforated, slots or other types of openings or skeletal structures may be utilized, care being taken to assure that sufficient substrate is available for adequately supporting the fabric coverings.

The outer surfaces of the top, rear and bottom walls 42, 44, 46 may be decorated to better simulate the upper edges, fore-edges and bottom edges of the leaves of the books. As examples, such decoration may be implemented with paint or dyes, or by covering the walls 42, 44, 46 with suitable fabric. The walls 42, 44, 46 need not be solid or continuous, but may be perforated or have slots or other openings therethrough.

The completed loudspeaker concealment housing 10 is represented in FIG. 1. The frames 20, 22, 24 are arranged on a support, such as a bookshelf or the top surface of a piece of furniture such as an end table, and are juxtaposed with one or more intermediate frames 24 between the left side frame 20 and the right side frame 22 with their openings 40 aligned to form the rectangular chamber 26 defined by the inner edges 38 of the longitudinal members 34, 36 and extending between the inner surfaces of the left side wall 62 and the right side wall 64. The dimensions of the inner edges 38 of the longitudinal members 34, 36 in each of the frame modules 20, 22, 24 are such that the chamber 26 formed when the frame modules 20, 22, 24 are arranged as just described is greater than the dimensions of the loudspeaker 12 to be installed within the chamber 26 with the speaker's front side 18 facing the forward walls 30 for permitting the speaker sound to be transmitted through the sound transmissible forward walls 30.

A bookshelf speaker 12 having a height h less than the inner edges 38 of the vertical members 36 may be vertically installed in the housing 10, provided the depth dimension d of the speaker 12 is less than the length of the edges 38 of the lower longitudinal members 34. In such installation, the width dimension w of the loudspeaker 12 will determine the quantity of intermediate frame modules 24 to be inserted between the left side frame module 20 and the right side frame module 22. For example, if the width dimension w of the speaker 12 is 6 inches, and the width dimension of the top walls 42 (i.e. its dimension parallel to the forward wall 30) is 1¾ inches, then a simple calculation will reveal that a minimum of four modules would be appropriate, i.e. at least two intermediate frame modules 24 would be juxtaposed between a left side frame module 20 and a right side frame module 22.

Alternatively, and likely more commonly, the speaker 12 may be horizontally placed within the housing 10. In a horizontal orientation, the speaker's left or right side (as viewed in FIG. 2) may rest upon the inner edges 38 of the lower members 34, with the speaker's front side 18 facing the forward walls 30 of the frame 20, 24, 22, provided the speaker's width dimension w is less than the length of the inner edges 38 of the vertical members 36 and the speaker's depth dimension d is less than the inner edges 38 of the horizontal members 34. The quantity of intermediate frame modules 24 to be inserted between the left and right side frame modules 20, 22, will be determined by the height h of the speaker 12 which is now horizontally disposed between the left and right side walls 62, 64. For example, if the height dimension h of the speaker 12 is 12 inches, and each of the frame modules 20, 24, 22 has an interior width (i.e., the dimension of the top edge 42 parallel to the forward wall 30) of 1¾ inches, then a total of six frame modules would appropriately be juxtaposed so that four intermediate frame modules 24 would be interposed between the left side frame module 20 and the right side frame module 22.

When the speaker 12 is inserted within the chamber 26 and is resting upon the lower longitudinal members 34, the speaker 12 serves the added function of maintaining the juxtaposed modules 20, 24, 22 in place. Accordingly, the modules 20, 24, 22 need not be secured to one another, although if desired they may be so secured by conventional fastening devices. Although an aperture in one of the walls of one or more of the modules may be provided for accommodating speaker and/or electrical wiring, such an aperture is not necessary since the wiring may be positioned between any two adjacent modules.

In an example of the process of setting up the modular housing for concealing the loudspeaker 12, the intermediate frame modules 24 may be juxtaposed to form a tunnel produced by the successive openings 40. The loudspeaker may then be placed in the tunnel, and the left side frame module 20 and the right side frame module 24 may be placed on the left and right side of the tunnel, respectively, thereby enclosing the loudspeaker within the juxtaposed frames 20, 24, 22. The resulting enclosure 10 will simulate a row of side-by-side books.

It may be appreciated that at least one of the side frame modules 20, 22 need not be utilized, so that the loudspeaker 12 may be housed within the aligned openings 40 of a plurality of juxtaposed intermediate frame modules 24. In such case, an open side of the juxtaposed intermediate frame modules 24 may face and be in proximity with a vertical wall of the bookcase holding the bookshelf upon which the loudspeaker housing is supported, or one or both of the side openings may be closed by a genuine book.

As an alternative to arranging the juxtaposed frame modules 20, 24, 22 with their forward walls 30 vertically disposed as shown in FIG. 1, the frame modules 20, 24, 22 may be juxtaposed with the longitudinal dimension of their forward walls 30 (i.e. the spines of the simulated books) horizontally disposed, with the speaker 12 contained within the chamber 26. In such orientation, the left side wall 62 may rest upon a horizontal surface such as a table top or bookshelf (or the left side frame module 20 may be omitted entirely) and the housing 10 would give the appearance of a plurality of stacked books with the right side wall 64 upwardly facing and simulating the front cover of the uppermost book.

In one example of frame modules 20, 24, 22 for being juxtaposed to produce a loudspeaker concealment housing 10, the inner edges 38 of the vertical members 36 were each approximately 7¼ inches, the inner edges 38 of the horizontal members 34 were each approximately 9½ inches, and the width dimension of each of the top walls 42 was approximately 1¾ inches. With a speaker 12 horizontally disposed in the chamber 26, the housing 10 of this example will permit concealment of speakers 12 having a width dimension w of up to nominally 7 inches, a depth dimension d of up to nominally 9 inches, and of unlimited height dimension h.

Thus, there has been shown a preferred embodiment of a housing for concealing a loudspeaker comprising frame modules which, when juxtaposed, appear as a row or stack of books, and wherein the quantity of frame modules may adjusted for accommodating speakers of different widths or heights. Other embodiments of the present invention, and other configurations of the embodiment shown herein, may be developed without departing from the essential characteristics thereof. For example, although bookshelf loudspeakers have been specifically described as the object of concealment, other types of loudspeakers may be placed as well within the concealment housing of the present invention. Accordingly, the invention should be limited only by the scope of the claims listed below.

I claim:

1. Apparatus for concealing a loudspeaker, comprising the combination of:

a generally rectangular individual first frame having a forward wall representing the spine of a first book, a top wall representing the top edges of the leaves of the first book, and a left side wall representing the back cover of the first book;

a generally rectangular individual second frame having a forward wall representing the spine of a second book, a top wall representing the top edges of the leaves of the second book, and a right side wall representing the front cover of the second book;

at least one generally rectangular individual third frame, each of said at least one third frame having a sound-transmissible forward wall representing the spine of another book, and a top wall representing the top edges of the leaves of the other book;

said individual frames adapted to be juxtaposed with said at least one third frame between said first frame and said second frame to form a housing for the loudspeaker.

2. The apparatus according to claim 1, wherein:

the outer surface of said forward wall of each of said at least one third frame is covered with sound transmissible fabric for simulating the spine of the other book.

3. The apparatus according to claim 2, wherein:

said at least one third frame further includes a rear wall representing the fore-edges of the leaves of the other book, and a bottom wall representing the bottom edges of the leaves of the other book; and the outer surfaces of said top, rear and bottom walls of each of said at least one third frame are decorated to simulate the leaves of the other book.

4. The apparatus according to claim 1, wherein:

the outer surface of said forward wall of each of said first and second frames is covered with fabric for simulating the spines of the first and second books.

5. The apparatus according to claim 4, wherein:

the outer surface of said side wall of each of said first and second frames is covered with fabric for simulating the back cover of the first book and the front cover of the second book.

6. The apparatus according to claim 1, wherein:

said forward wall of each of said first and second frames is sound transmissible.

7. The apparatus according to claim 1, wherein:

the outer surface of said forward wall of each of said first and second frames is covered with fabric for simulating the spines of the first and second books;

the outer surface of said side wall of each of said first and second frames is covered with fabric for simulating the back cover of the first book and the front cover of the second book; and the outer surface of said front wall of each of said at least one third frame is covered with sound transmissible fabric for simulating the spine of the other book.

8. The apparatus according to claim 7, wherein:

said at least one third frame further includes a rear wall representing the fore-edges of the leaves of the other book, and a bottom wall representing the bottom edges of the leaves of the other book; and the outer surfaces of said top, rear and bottom walls of each of said at least one third frame are decorated to simulate the leaves of the other book.

9. The apparatus according to claim 1, wherein each of said at least one third rectangular frame comprises:

a first component including said forward wall of said third frame;

a second component including said top wall, a rear wall and a bottom wall of said third frame; and fasteners securing said components to one another.

10. The apparatus according to claim 1, wherein said first rectangular frame comprises:

a first component including said forward wall of said first frame and said left side wall;

a second component including said top wall, a rear wall and a bottom wall of said first frame; and fasteners securing said components to one another.

11. The apparatus according to claim 1, wherein said second rectangular frame comprises:

a first component including said forward wall of said second frame and said right side wall;

a second component including said top wall, a rear wall and a bottom wall of said second frame; and fasteners securing said components to one another.

12. Apparatus for concealing a loudspeaker, comprising:

a plurality of generally individual rectangular first frames each having a sound transmissible forward wall simulating the spine of a book, each of said first frames having a top wall and a bottom wall each perpendicularly extending from said forward wall, each of said first frames having a rear wall parallel to said forward wall, each of said first frames including an opening therethough within the boundaries of said walls, said frames adapted to be juxtaposed with said openings aligned to form a housing for the loudspeaker.

13. The apparatus according to claim 12, further including:

a generally rectangular second frame having a forward wall simulating the spine of another book, said second frame having a top wall and a bottom wall each perpendicularly extending from said forward wall of said second frame, said second frame having a rear wall parallel to said forward wall of said second frame, said second frame having a right side wall simulating the front cover of the other book, said second frame including an opening within the boundaries of said forward, top, rear and bottom walls of said second frame, said second frame adapted to be juxtaposed with said first frames with said openings aligned to form the housing.

14. The apparatus according to claim 12, further including:

a generally rectangular second frame having a forward wall simulating the spine of another book, said second frame having a top wall and a bottom wall each perpendicularly extending from said forward wall of said second frame, said second frame having a rear wall parallel to said forward wall of said second frame, said second frame having a left side wall simulating the back cover of the other book, said second frame including an opening within the boundaries of said forward, top, rear and bottom walls of said second frame, said second frame adapted to be juxtaposed with said first frames with said openings aligned to form the housing.

15. The apparatus according to claim 14, further including:

a generally rectangular third frame having a forward wall simulating the spine of another book, said third frame having a top wall and a bottom wall each perpendicularly extending from said forward wall of said third frame, said third frame having a rear wall parallel to said forward wall of said third frame, and said third frame having a right side wall simulating the front cover of the other book, said third frame including an opening within the boundaries of said forward, top, rear and bottom walls of said third frame, said third frame adapted to be juxtaposed with said first frames between said second and third frames and with said openings aligned to form the housing.

16. Apparatus for concealing a loudspeaker, comprising the combination of:

an individual first frame having a rectangular opening, said first frame including a forward wall representing the spine of a first book, and a left side wall representing the back cover of the first book closing said opening;

an individual second frame having a rectangular opening, said second frame including a forward wall representing the spine of a second book, and a right side wall representing the front cover of the second book closing said opening;

at least one individual third frame, each of said at least one third frame having a rectangular opening and a sound-transmissible forward wall representing the spine of another book;

said frames adapted to be juxtaposed with said at least one third frame between said first frame and said second frame and with said openings aligned to form a housing for the loudspeaker.

17. The apparatus according to claim 16, wherein:

said frames are generally rectangular.

18. The apparatus according to claim 16, wherein:

said first frames includes a top wall representing the top edges of the leaves of the first book;

said second frame further includes a top wall representing the top edges of the leaves of the second book; and each of said at least one third frame further includes a top wall representing the top edges of the leaves of the other book.

19. The apparatus according to claim 16 wherein:

said first frame further includes a rear wall representing the fore-edges of the leaves of the first book and a bottom wall representing the bottom edges of the leaves of the first book;

said second frame further includes a rear wall representing the fore-edges of the leaves of the second book, and a bottom wall representing the bottom edges of the leaves of the second book; and said at least one third frame further includes a rear wall representing the fore-edges of the leaves of the other book, and a bottom wall representing the bottom edges of the leaves of the other book.

20. A method of concealing a loudspeaker, comprising:

providing a plurality of intermediate individual frames each having a rectangular opening and simulating the spine and leaf edges of a book; and juxtaposing said plurality of intermediate frames with said openings aligned to form a tunnel with open sides for containing the loudspeaker.

21. The method according to claim 20, further including:

providing the loudspeaker; and placing said loudspeaker in said tunnel.

22. The method according to claim 20, further including:

providing a left side frame having a rectangular opening and simulating the back cover, the spine and the leaf edges of a book;

providing a right side frame having a rectangular opening and simulating the front cover, the spine and the leaf edges of a book;

providing loudspeaker;

placing said loudspeaker in said tunnel; and placing a one of said side frames on a side of said tunnel with said openings aligned.

23. The method according to claim 22, further including:

placing the other one of said side frames on the other side of said tunnel with said openings aligned for enclosing the loudspeaker.

* * * * *